US006879095B2

(12) United States Patent
Ito et al.

(10) Patent No.: US 6,879,095 B2
(45) Date of Patent: Apr. 12, 2005

(54) DEFLECTION YOKE AND CATHODE RAY TUBE APPARATUS PROVIDED WITH THE SAME

(75) Inventors: Yoshiaki Ito, Fukaya (JP); Tadahiro Kojima, Kumagaya (JP); Takashi Murai, Fukaya (JP); Masatsugu Inoue, Kumagaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/694,049

(22) Filed: Oct. 28, 2003

(65) Prior Publication Data

US 2004/0100212 A1 May 27, 2004

Related U.S. Application Data

(63) Continuation of application No. PCT/JP03/01930, filed on Feb. 21, 2003.

(30) Foreign Application Priority Data

Feb. 21, 2002 (JP) ..... 2002-045156

(51) Int. Cl.[7] ..... H01J 29/70

(52) U.S. Cl. ..... 313/440; 313/421; 313/426; 335/210

(58) Field of Search ..... 313/440, 421, 313/426, 432, 437, 439, 413, 431; 335/210

(56) References Cited

U.S. PATENT DOCUMENTS 5,281,938 A 1/1994 Okuyama et al.
5,408,163 A * 4/1995 Milili et al. ..... 315/370
6,198,368 B1 * 3/2001 Nam ..... 335/210
2002/0008458 A1 1/2002 Akoh et al.

FOREIGN PATENT DOCUMENTS

| | | | |
|---|---|---|---|
| EP | 481216 A1 * | 4/1992 | ..... H01J/29/76 |
| JP | 58-19453 | 2/1983 | |
| JP | 62-154441 | 7/1987 | |
| JP | 2000-57968 | 2/2002 | |
| JP | 2002-42691 | 2/2002 | |
| JP | 2002-216667 | 8/2002 | |
| JP | 2002-329467 | 11/2002 | |

* cited by examiner

*Primary Examiner*—Nimeshkumar D. Patel
*Assistant Examiner*—German Colón
(74) *Attorney, Agent, or Firm*—Pillsbury Winthrop LLP

(57) ABSTRACT

A deflection yoke on a yoke mounting portion with a truncated pyramid shape has a pair of saddle-type horizontal deflecting coils that is located symmetrically with a central axis and has a truncated pyramid shape. A core with a truncated cone shape is coaxially located on the outer periphery of the horizontal deflecting coils. A pair of vertical deflecting coils are toroidally wound around the core. If the positions of a horizontal axis and a vertical axis are given by 0° and 90°, respectively, in the circumference direction around the central axis, the winding of one vertical deflecting coil has a starting point on the horizontal-axis side within the range of 5°–30° and is distributed from the starting point to 90° and wound symmetrically with the vertical axis. The windings of the vertical deflecting coils are wound symmetrically with the horizontal axis.

8 Claims, 7 Drawing Sheets

| | | Present proposal | Prior art product |
|---|---|---|---|
| Conv. | YH | −0.01 | −3.44 |
| | PQH | 0.14 | −6.71 |
| | PQV | 0.03 | −5.52 |
| Distortion | NS | 0.23 | 1.02 |
| | EW | 15.6 | 17.1 |

All in [mm]

| | | Divided | Not divided |
|---|---|---|---|
| Conv. | YH | −0.01 | −1.04 |
| | PQH | 0.14 | −1.91 |
| | PQV | 0.03 | −1.64 |
| Distortion | NS | 0.23 | 0.47 |
| | EW | 15.6 | 16.0 |

All in [mm]

DEFLECTION YOKE AND CATHODE RAY TUBE APPARATUS PROVIDED WITH THE SAME

CROSS-REFERENCE TO RELATED APPLICATIONS

This is a Continuation Application of PCT Application No. PCT/JP03/01930, filed Feb. 21, 2003, which was not published under PCT Article 21 (2) in English.

This application is based upon and claims the benefit of priority from the prior Japanese Patent Application No. 2002-045156, filed Feb. 21, 2002, the entire contents of which are incorporated herein by reference.

BACKGROUND OF THE INVENTION

1. Field of the Invention

The present invention relates to a deflection yoke in a cathode ray tube apparatus, such as a color picture tube, and a cathode ray tube apparatus provided with the same.

2. Description of the Related Art

A color picture tube, for use as a cathode ray tube apparatus, for example, comprises a vacuum envelope that is formed of a glass panel having a substantially rectangular effective portion, a glass funnel coupled to the panel, and a cylindrical glass neck coupled to a small-diameter portion of the funnel. A phosphor screen is formed on the inner surface of the effective portion of the panel. The phosphor screen is composed of dot- or stripe-shaped three-color phosphor layers, which glow blue, green, and red, individually, and a black shielding layer. In the vacuum envelope, a shadow mask that has a large number of electron beam passage apertures is opposed to the phosphor screen. An electron gun that emits three electron beams is located in the neck, and a deflection yoke is mounted on a yoke mounting portion of the funnel. The yoke mounting portion is situated ranging from the outer periphery of the neck to the outer peripheral surface of the funnel.

In the color picture tube constructed in this manner, the three electron beams emitted from the electron gun are deflected in horizontal and vertical directions by horizontal and vertical deflecting magnetic fields that are generated by the deflection yoke, and the electron beams scan the phosphor screen horizontally and vertically through the shadow mask. By doing this, a color image is displayed.

A self-convergence in-line color picture tube is widely practically used as the color picture tube of the aforesaid type. According to this color picture tube, the electron gun is of an in-line type that emits three electron beams that are arranged in a line on the same plane. The deflection yoke is designed to generate a horizontal deflecting magnetic field of the pincushion type and a vertical deflecting magnetic field of the barrel type. The three electron beams that are emitted from the electron gun and arranged in a line can be deflected by the horizontal and vertical deflecting magnetic fields, and the three in-line electron beams can be converged for the entire phosphor screen without requiring use of any special correcting means.

In the color picture tube of this type, on the other hand, the deflection yoke is a substantial source of power consumption. In order to lower the power consumption of a cathode ray tube, therefore, it is essential to reduce the power consumption of the deflection yoke. In recent years, there has been a demand for higher resolution and visibility, and use conditions for high deflecting frequency have been increasing. If the deflection yoke is worked at the high frequency, heat release from the deflection yoke is enormous. The deflecting frequency must be increased in order to match the monitor of an OA apparatus such as an HD (high definition) television or PC (personal computer). Both these circumstances entail increased deflecting power and increased heat release from the deflection yoke.

In order to lower the deflecting power, in general, the neck diameter of the cathode ray tube should be lessened to reduce the outside diameter of the yoke mounting portion on which the deflection yoke is mounted. By doing this, the space on which the deflecting magnetic fields act can be narrowed, so that the deflecting magnetic field can efficiently act on the electron beams.

In the conventional cathode ray tube apparatus that has the yoke mounting portion in the shape of a truncated cone, however, the electron beams are already brought close to the inner surface of the yoke mounting portion of the vacuum envelope when they pass through the envelope. If the neck diameter or the outside diameter of the yoke mounting portion is further reduced, therefore, the electron beams hit the inner surface of the yoke mounting portion before they reach the phosphor screen. Thus, the electron beams inevitably fail to land on some parts of the phosphor screen corresponding to the maximum deflection angle. If the electron beams continue to hit the inner surface of the yoke mounting portion, the hit portions are heated to a temperature high enough to melt glass, so that the vacuum envelope may possibly implode. In the conventional cathode ray tube apparatus, therefore, it is hard to lower the deflecting power by further reducing the neck diameter or the outside diameter of the yoke mounting portion.

If a rectangular raster is generated on the phosphor screen, the region through which the electron beams pass, inside the yoke mounting portion on which the deflection yoke is mounted, also has a substantially rectangular shape. In consideration of this context, the above problems are solved by forming the yoke mounting portion of the funnel so that its shape gradually changes from a circular configuration into a substantially rectangular configuration with distance from the neck or as the panel is approached.

If the yoke mounting portion of the funnel is formed substantially in the shape of a truncated pyramid in this manner, the diameters of the yoke mounting portion in the directions of its major axis (horizontal axis) and minor axis (vertical axis) can be shortened without changing the diameter in the diagonal direction corresponding to the maximum deflection angle. Thus, horizontal and vertical deflecting coils of the deflection yoke can be brought close to the electron beams, so that the electron beams can be efficiently deflected to lower the deflecting power.

There are deflection yokes of various types, including a saddle-saddle-type deflection yoke of which both the horizontal and vertical deflecting coils are of the saddle type, a semi-toroidal deflection yoke having a toroidal vertical deflecting coil, etc. A saddle-saddle-type deflection yoke described in Jpn. Pat. Appln. KOKAI Publication No. 11-265668, for example, comprises a pair of saddle-type horizontal deflecting coils, a pair of saddle-type vertical deflecting coils, and a magnetic core. The horizontal deflecting coils, which are wound in the shape of a truncated pyramid, are located inside an insulating separator. The vertical deflecting coils, which are wound in the shape of a truncated pyramid, are located outside the separator. The core, which has the shape of a truncated pyramid, is provided outside the vertical deflecting coils so as to cover them.

The saddle-saddle-type deflection yoke having the aforesaid basic structure can lower the deflecting power more than the semi-toroidal deflection yoke can. It is hard, however, to manufacture a core of a magnetic material having the shape of a truncated pyramid, and it is also difficult to wind the vertical deflecting coils toroidally around the truncated-pyramid-shaped core. Thus, the deflection yoke entails high cost and lacks in versatility.

BRIEF SUMMARY OF THE INVENTION

The present invention has been contrived in consideration of these circumstances, and its object is to provide a deflection yoke of a cathode ray tube apparatus, capable of efficiently converging electron beams and enjoying improved image characteristic for the entire picture plane, and a color cathode ray tube apparatus provided with the same.

In order to achieve the above object, a deflection yoke according to an aspect of this invention comprises a pair of saddle-type horizontal deflecting coils located symmetrically with respect to a central axis and having the shape of a truncated pyramid; a magnetic core coaxial with the central axis, located on an outer peripheral side of the horizontal deflecting coils, and having the shape of a truncated cone; and a pair of vertical deflecting coils toroidally wound around the magnetic core. If the position of a horizontal axis perpendicular to the central axis and the position of a vertical axis perpendicular to the central axis and the horizontal axis are given by 0° and 90°, respectively, in the direction of the circumference of a circle around the central axis, the winding of one of the vertical deflecting coils has a starting point on the horizontal-axis side within the range of 5°–30° and is distributed continuously or intermittently from the starting point to 90° and wound symmetrically with respect to the vertical axis. The respective windings of the vertical deflecting coils are wound symmetrically with respect to a horizontal axis A cathode ray tube apparatus according to another aspect of this invention comprises a vacuum envelope including a panel having a phosphor screen formed on the inner surface thereof, a funnel adjoining the panel, and a cylindrical neck adjoining a small-diameter end of the funnel, and formed having a yoke mounting portion substantially in the shape of a truncated pyramid and ranging from the neck to the outer periphery of the funnel, an electron gun which is located in the neck of the vacuum envelope and emits electron beams toward the phosphor screen, and the aforesaid deflection yoke which is mounted on the outside of the yoke mounting portion and deflects the electron beams in horizontal and vertical directions.

According to the deflection yoke constructed in this manner and the cathode ray tube apparatus provided with the same, the horizontal deflecting coils are formed substantially having the shape of a truncated pyramid, so that the electron beams can be efficiently deflected to lower the deflecting power. Further, the yoke and the apparatus can be easily manufactured with use of the magnetic core substantially in the shape of a truncated cone.

In the deflection yoke, the starting point of the winding distribution of the vertical deflecting coil on the horizontal-axis side is within the range of 5°–30°, and the coil is wound in a wide range. Thus, the electron beams can be converged efficiently, so that the image characteristic of the entire picture screen can be improved.

BRIEF DESCRIPTION OF THE SEVERAL VIEWS OF THE DRAWING

The accompanying drawings, which are incorporated in and constitute a part of the specification, illustrate an embodiment of the invention, and together with the general description given above and the detailed description of the embodiment given below, serve to explain the principles of the invention.

DETAILED DESCRIPTION OF THE INVENTION

A color cathode ray tube apparatus according to an embodiment of this invention will now be described in detail with reference to the drawings.

Figure 1:
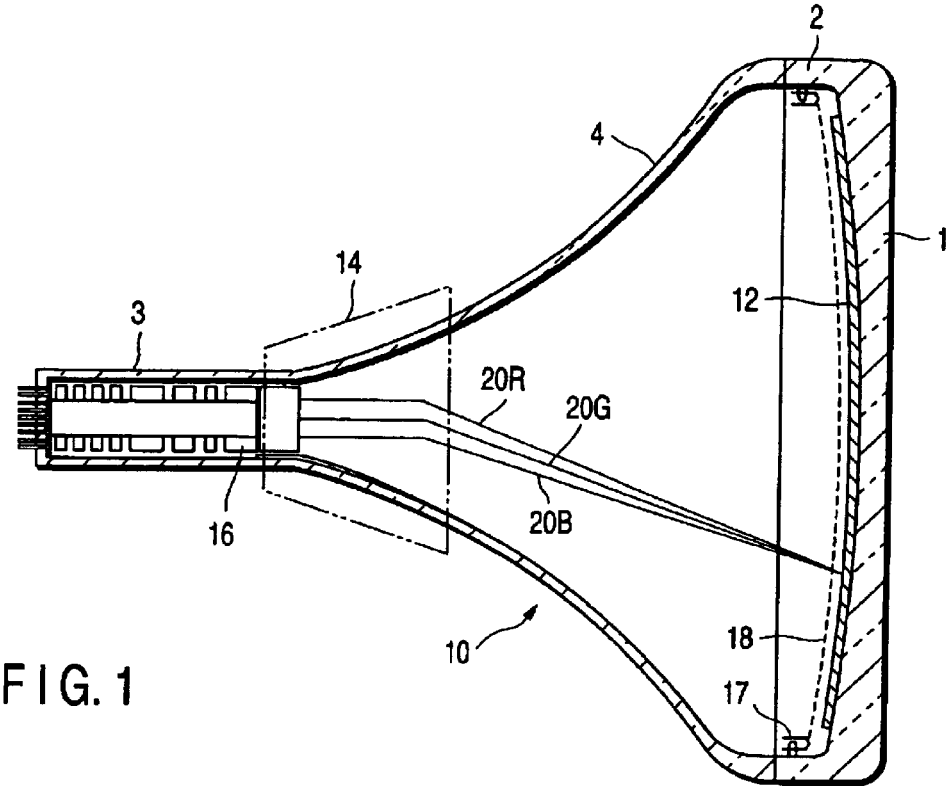
FIG. 1 is a sectional view showing a color cathode ray tube apparatus according to an embodiment of this invention.
Figure 2:
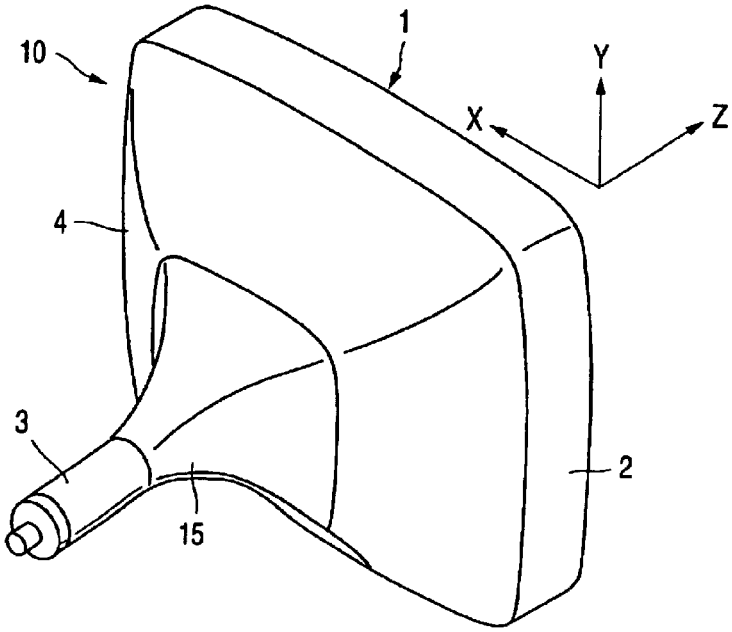
FIG. 2 is a perspective view showing the back side of a vacuum envelope of the color cathode ray tube apparatus.
Figure 3A:
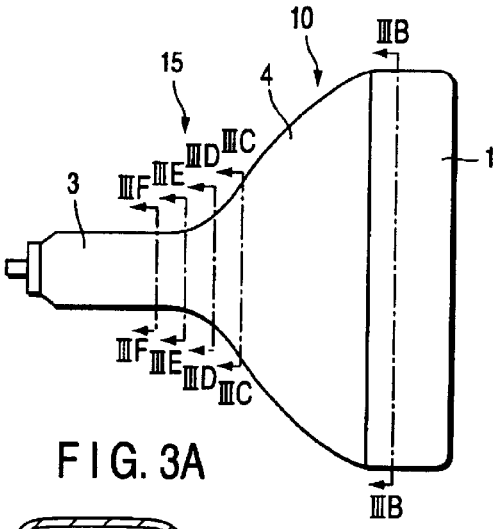
FIG. 3A is a side view of the vacuum envelope.
Figure 3B:
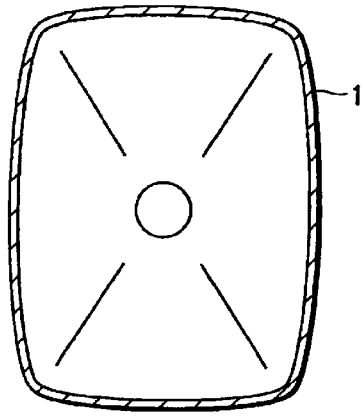
FIGS. 3B, 3C, 3D, 3E and 3F are a sectional view of a yoke mounting portion taken along line IIIB—IIIB of FIG. 3A, sectional view of the yoke mounting portion taken along line IIIC—IIIC of FIG. 3A, sectional view of the yoke mounting portion taken along line IIID—IIID of FIG. 3A, sectional view of the yoke mounting portion taken along line IIIE—IIIE of FIG. 3A, and sectional view of the yoke mounting portion taken along line IIIF—IIIF of FIG. 3A, respectively.
Figure 3C:
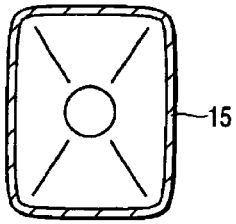
Figure 3D:
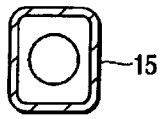
Figure 3E:
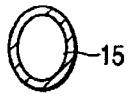
Figure 3F:
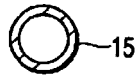
Figure 4:
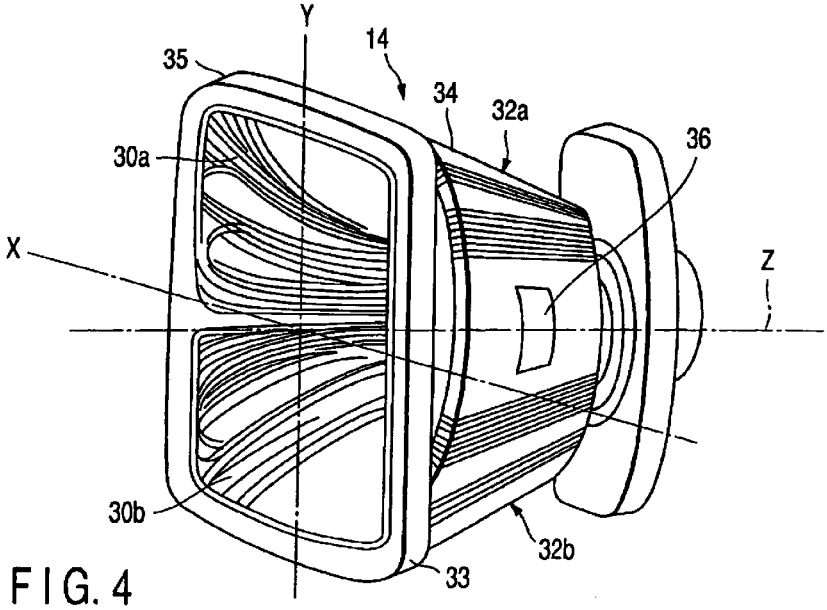
FIG. 4 is a perspective view of a deflection yoke of the color cathode ray tube apparatus.
Figure 5:
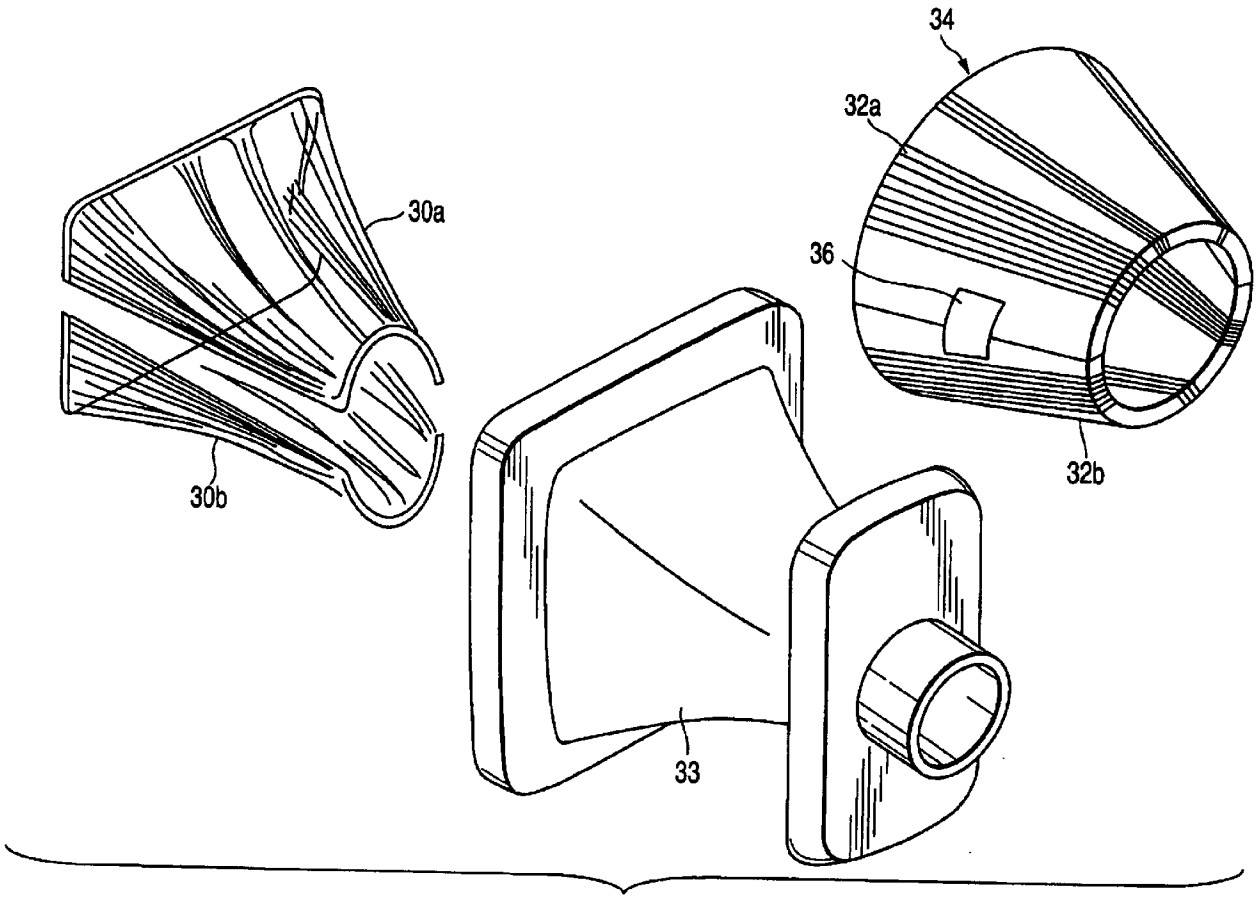
FIG. 5 is an exploded perspective view of the deflection yoke.

As shown in FIGS. 1 and 2, the color cathode ray tube apparatus comprises a vacuum envelope 10. The vacuum envelope includes a substantially rectangular panel 1 having a skirt portion on its peripheral edge, a funnel 4 coupled to the skirt portion of the panel, and a cylindrical neck 3 coupled to a small-diameter portion of the funnel. On the inner surface of the panel 1 is formed a phosphor screen 12 that is made of a plurality of phosphor layers that glows red, green, and blue, individually, and a shielding layer. The funnel 4 has a yoke mounting portion 15 that extends from the neck 3 toward the panel, and a deflection yoke 14 is mounted on the outer periphery of the yoke mounting portion. Located inside the neck is an electron gun 16 that emits three electron beams 20R, 20G, and 20B toward the phosphor layers of the phosphor screen, individually.

A shadow mask 18 having a color sorting function is arranged inside the panel 1 and supported by a mask frame 17. The shadow mask 18 has a large number of electron beam passage apertures, through which the electron beams 20R, 20G and 20B emitted from the electron gun 16 reach the phosphor layers corresponding to the individual colors for color sorting.

The vacuum envelope 10 has a tube axis Z, horizontal axis (major axis) X, and vertical axis (minor axis) Y. The tube axis Z, which is coaxial with the neck 3, extends through the center of the phosphor screen 12. The horizontal axis X extends at right angles to the tube axis. The vertical axis Y extends at right angles to the tube axis and the horizontal axis.

In the color cathode ray tube apparatus constructed in this manner, the electron beams 20R, 20G and 20B emitted from the electron gun 16 are deflected by horizontal and vertical deflecting magnetic fields that are generated from the deflection yoke 14. After color sorting by means of the shadow mask 18 is accomplished, the electron beams scan the phosphor screen 12 horizontally and vertically to display an image.

As shown in FIG. 2 and FIGS. 3A to 3F, the yoke mounting portion 15 of the vacuum envelope 10 is formed having a shape such that its sectional shape gradually changes from a circular configuration into a substantially rectangular configuration as the panel 1 is approached. Since the yoke mounting portion 15 is formed substantially in the shape of a truncated pyramid in this manner, the diameters of the deflection yoke 14 in the direction of the horizontal axis X and in the direction of the vertical axis Y can be reduced. Thus, a horizontal deflecting coil of the deflection yoke 14 can be brought close to the electron beams to deflect them efficiently, so that its deflecting power can be lowered.

As shown in FIG. 1 and FIGS. 4 to 6B, the deflection yoke 14 is provided with a pair of horizontal deflecting coils 30*a* and 30*b* and a pair of vertical deflecting coils 32*a* and 32*b*. The horizontal deflecting coils 30*a* and 30*b* generate a magnetic field for deflecting the electron beams in the direction of the horizontal axis X. The vertical deflecting coils 32*a* and 32*b* generate a magnetic field for deflecting the electron beams in the direction of the vertical axis Y. The paired horizontal deflecting coils 30*a* and 30*b* are made of a saddle-type coil each, and the two horizontal deflecting coils are associated with each other to form a structure substantially in the shape of a truncated pyramid. These horizontal deflecting coils 30*a* and 30*b* are mounted along the inner peripheral surface of a separator 33 that is formed of synthetic resin or the like. The separator is substantially in the shape of a truncated pyramid corresponding to the yoke mounting portion 15.

A core 34 of a magnetic material in the shape of a truncated cone is mounted on the outer peripheral side of the separator 33 so as to surround the separator coaxially. The paired vertical deflecting coils 32*a* and 32*b* are toroidally wound around the core 34. The core 34 is formed so that it can be divided in two along a plane that contains its central axis, and its divisions are fixed to each other by fasteners 36.

A coma coil 40 for correcting coma is coaxially located on a small-diameter portion of the separator 33, and is situated at a given distance from the small-diameter end of the core 34.

In the deflection yoke 14 described above, the inside or outside diameter of the panel-side end or a large-diameter end portion of the core 34 in the shape of a truncated cone is settled corresponding to the diameter of the horizontal deflecting coils 30*a* and 30*b* on the diagonal axis on the large-diameter side, in consideration of an optimum position relative to the horizontal deflecting coils 30*a* and 30*b* in the shape of a truncated pyramid and their length in the direction of the tube axis Z. Thus, if the horizontal deflecting coils 30*a* and 30*b* are formed in the shape of a truncated pyramid and the core 34 in the shape of a truncated cone, the outer peripheral surface of the core is situated closest to the diagonal axis portion of each horizontal deflecting coil.

Figure 6A:
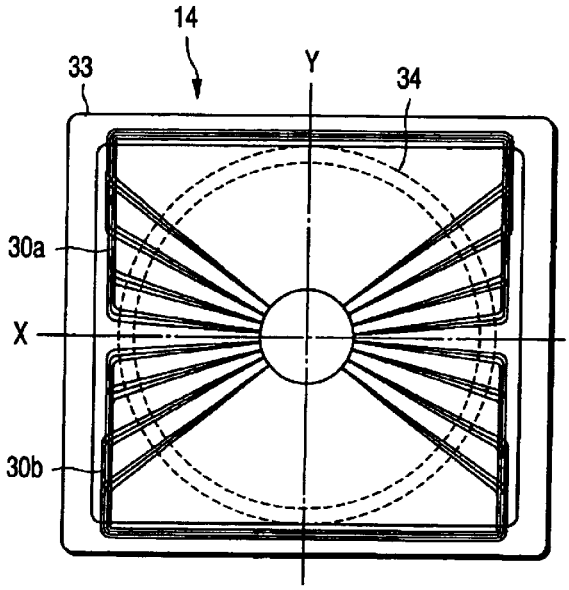
FIG. 6A is a front view of the deflection yoke.
Figure 6B:
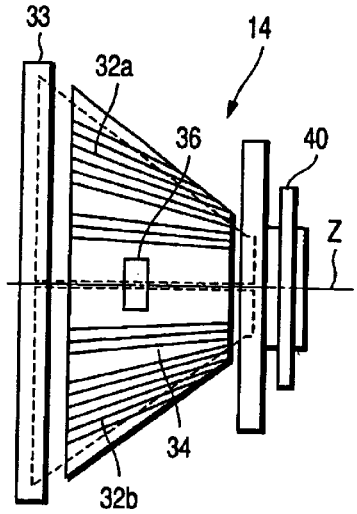
FIG. 6B is a side view of the deflection yoke.
Figure 7:
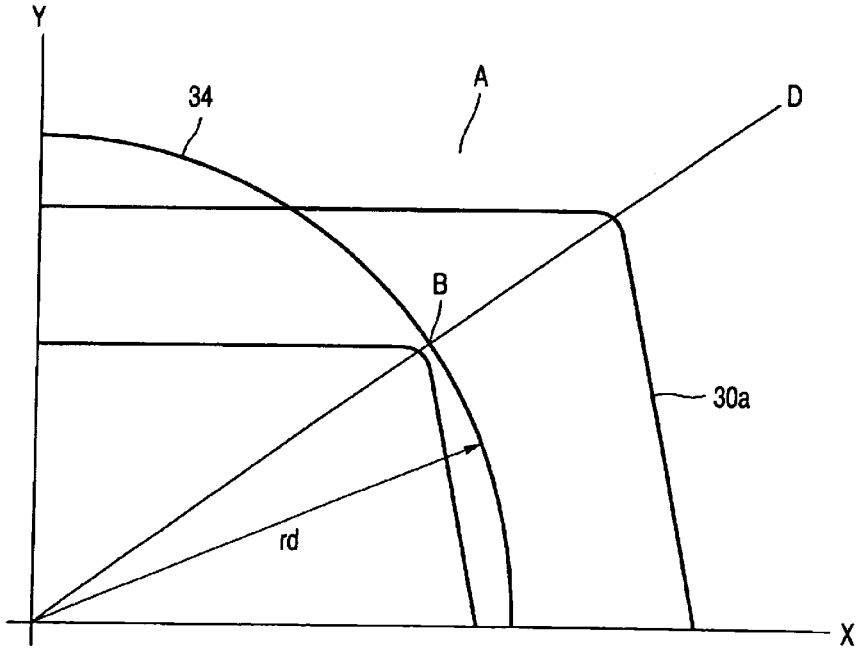
FIG. 7 is a side view schematically showing the configuration of a core and horizontal deflecting coils of the deflection yoke.

As shown in FIGS. 6A and 6B and FIG. 7, therefore, the radius of the large-diameter end portion of the core 34 is adjusted to a radius (rd) that is substantially equal to the diagonal diameter of the horizontal deflecting coils 30*a* and 30*b* in a position B where the diagonal axis of each horizontal deflecting coil crosses a plane A that contains the large-diameter end portion and extends at right angles to the tube axis Z.

Figure 8:
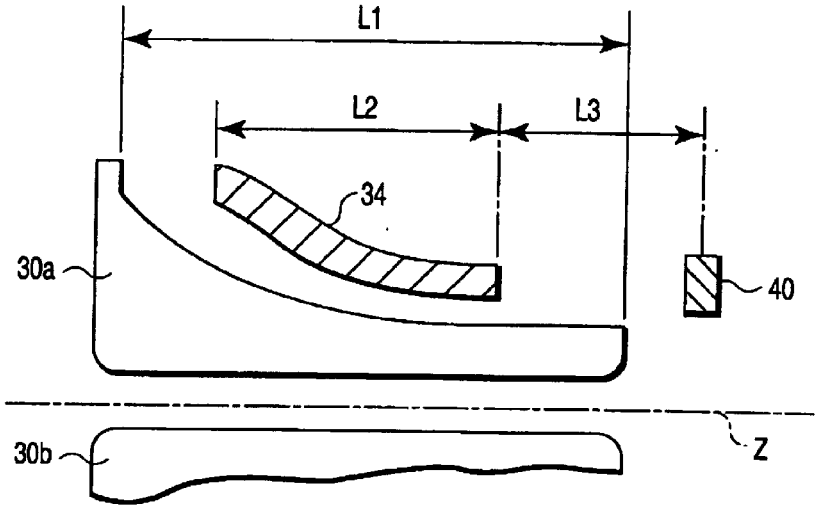
FIG. 8 is a view schematically showing the positional relations between the core, the horizontal deflecting coils, and a coma coil of the deflection yoke in the direction of its central axis.

As shown in FIG. 8, the horizontal deflecting coils 30*a* and 30*b* are formed as bendless coils that have no bends on their respective neck-side small-diameter ends in the direction perpendicular to the tube axis Z. If the effective length of the horizontal deflecting coil 30*a* in the direction of the tube axis Z, the length of the core 34, and the distance between the small-diameter end of the core and the center of the coma coil 40 are L1, L2 and L3, respectively, they have the following relations:

$$L1>L2>L3,$$

$$L3=0.6\times L2-0.8\times L2.$$

Figure 9:
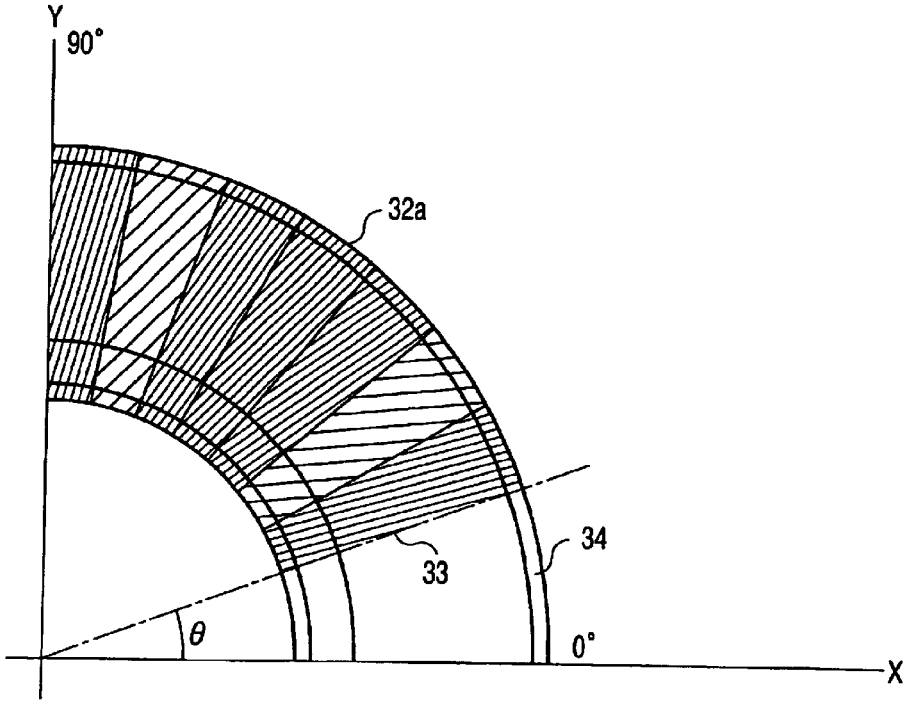
FIG. 9 is a diagram showing the winding distribution of vertical deflecting coils of the deflection yoke.

The winding distribution of the deflection yoke 14 will now be described in detail with reference to FIGS. 9 and 10. Let it be supposed that the position of the horizontal axis X and the position of the vertical axis Y are adjusted to angles of 0° and 90°, respectively, with respect to the circumferential direction around the tube axis Z, in the deflection yoke that is applied to a flat color cathode ray tube apparatus having a diagonal dimension of 66 cm, for example. In this case, the vertical deflecting coil 32*a* is wound so that a starting point 33 of the winding is restricted to the range of θ=5°–30° to the horizontal axis X and that the winding is distributed continuously or intermittently within the range from the starting point 33 to 90°. In the present embodiment, the vertical deflecting coil 32*a* is wound within the range of 20°–90°, as indicated by full line in FIG. 10. Further, the vertical deflecting coil 32*a* is wound so that its winding distribution is close in three positions near the ranges of 22°–28°, 40°–70°, and 83°–88°.

The vertical deflecting coil 32*a* is wound bisymmetrically with respect to the vertical axis Y. Further, the respective windings of the vertical deflecting coil 32*b* and the vertical deflecting coil 32*a* are wound symmetrically with respect to the horizontal axis X.

Figures 10, 11, 12:
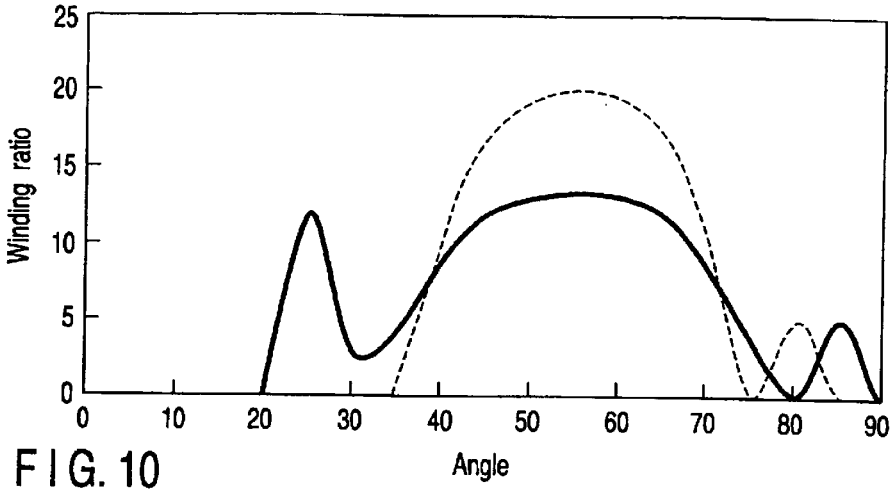
FIG. 10 is the winding distribution of the vertical deflecting coils of the deflection yoke compared with the conventional case.
FIG. 11 is a diagram showing the result of a comparative experiment on the electron beam convergence and the distortion characteristic of the deflection yoke according to the present embodiment and a conventional deflection yoke.
FIG. 12 is a diagram showing the result of a comparative experiment on the electron beam convergence and the distortion characteristic for the case where the winding distribution of the deflection yoke is divided in a plurality of parts and the case where the winding distribution is not divided.

In a conventional deflection yoke that is provided with saddle-type horizontal deflecting coils substantially in the shape of a truncated cone and a semi-toroidal vertical deflecting coil, the winding range of the vertical deflecting coil is as narrow as about 35°–85°, and its distribution curve is in the shape of a mountain such that the central part of the winding has the highest winding ratio, as indicated by broken line in FIG. 10.

According to the color cathode ray tube apparatus constructed in this manner, the yoke mounting portion 15 of the vacuum envelope 10 is formed substantially having the shape of a truncated pyramid, while the horizontal deflecting coils 30*a* and 30*b* are formed substantially having the shape of a truncated pyramid corresponding to the yoke mounting portion 15. Accordingly, the diameters of the horizontal deflecting coils 30*a* and 30*b* in the directions of the horizontal and vertical axes can be reduced without changing the conventional diagonal diameter along which the electron beams deflect at the widest angle. Thus, the horizontal deflecting coils 30*a* and 30*b* can be brought close to the electron beams. In consequence, the electron beams can be efficiently deflected to lower the deflecting power of the deflection yoke 14.

The core 34 is formed substantially having the shape of a truncated cone, and the vertical deflecting coils 32*a* and 32*b* are wound toroidally. When compared with the case where the core is substantially in the shape of a truncated pyramid, therefore, the deflection yoke can be manufactured more easily at lower cost, and at the same time, satisfactory properties can be obtained.

The deflection yoke 14, compared with the conventional deflection yoke, has its winding distribution changed considerably. In the vertical deflecting coil, in particular, the winding is formed in the aforesaid wide range of 20°–90°. Thus, a color cathode ray tube apparatus can be obtained such that the electron beams 20R, 20G and 20B can be converged efficiently and the image characteristic of the entire picture plane is improved.

More specifically, a more intense barrel magnetic field can be formed in the vertical deflecting magnetic field by bringing the starting point of the winding distribution of the vertical deflecting coils 32*a* and 32*b* close to the horizontal axis X to widen the winding range in the aforesaid manner. Thus, the convergence of the electron beams can be improved.

Figure 13:
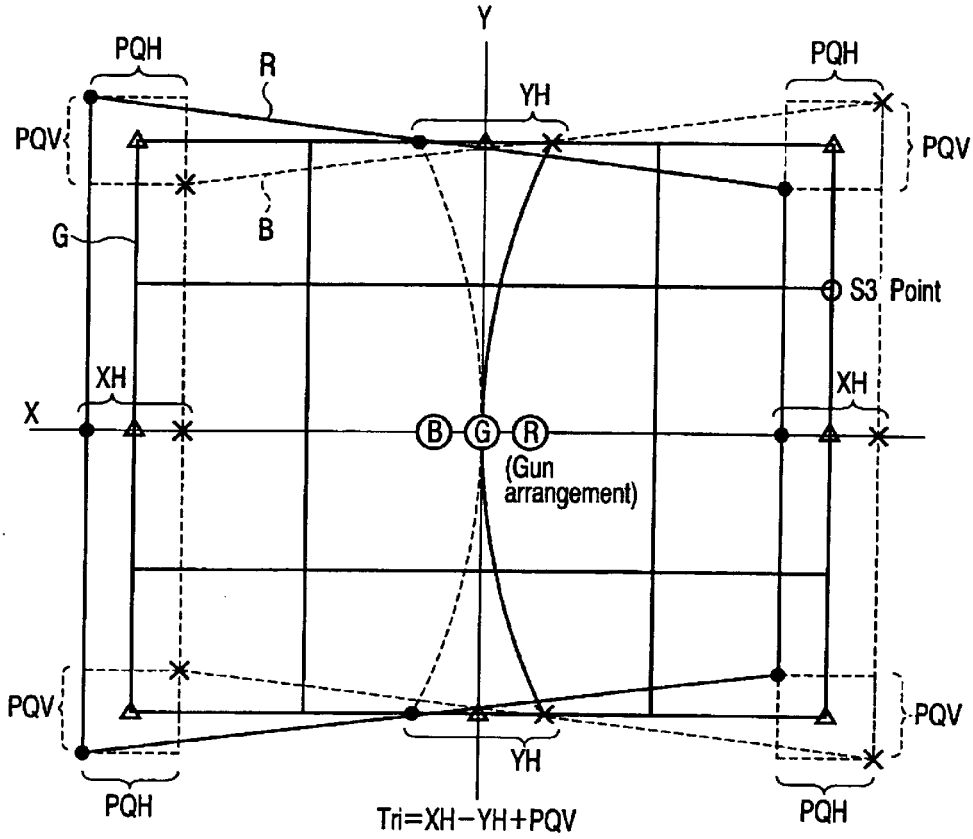
FIG. 13 is a view schematically showing a crosshatch picture used in a measuring method for the electron beam convergence.
Figure 14:
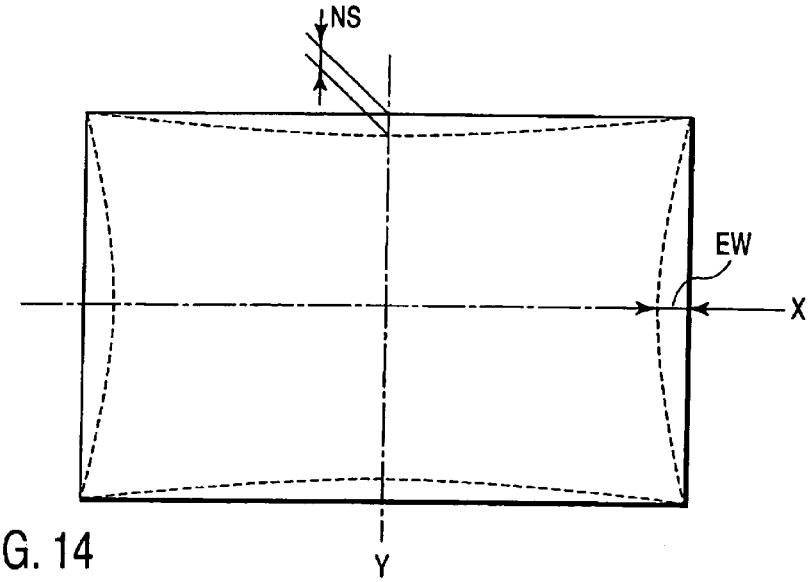
FIG. 14 is a view schematically showing a measuring method for the distortion characteristic.

The inventors hereof made an experiment to compare the convergence and the image distortion characteristic of the conventional deflection yoke and the deflection yoke of which the winding range of the vertical deflecting coil was set according to the foregoing embodiment. FIG. 11 shows the result. As shown in FIG. 13, YH indicates a dislocation between electron beams R and B in the direction of the horizontal axis X at the end of the vertical axis Y of the screen. PQH indicates a dislocation between the electron beams R and B in the direction of the horizontal axis X at the diagonal-axis end of the screen, and PQV indicates a dislocation between the electron beams R and B in the direction of the vertical axis Y at the diagonal-axis end of the screen. FIG. 13 shows a crosshatch screen, in which Δ—Δ represents the position on the screen reached by an electron beam G. Further, X—X represents the position on the screen reached by the electron beam B, and ●—● represents the position on the screen reached by the electron beam R. As shown in FIG. 14, moreover, an NS distortion represents a dislocation between a target image and an actual raster at each end of the vertical axis Y caused when a rectangular image is displayed. Likewise, an EW distortion represents a dislocation between the target image and the actual raster at each end of the horizontal axis X.

If the deflection yoke according to the present embodiment is used, as seen from the result shown in FIG. 11, YH, PQH and PVH are all made less than in the conventional case, so that the convergence of the electron beams is improved. As this is done, the NS distortion and the EW distortion are lessened, so that the image characteristic of the entire picture plane can be improved.

The starting point of the winding distribution of the vertical deflecting coils 32*a* and 32*b* is brought close to the horizontal axis X to widen the winding range. As this is done, the degrees of freedom of the design and mounting position of the coma coil 40 are improved, so that the degree of freedom of the design of the horizontal deflecting coils is also improved. For example, the coma coil 40 can be located nearer to the neck than the conventional deflection yoke is. Thus, the respective neck-side ends of the horizontal deflecting coils 30*a* and 30*b* can be made bendless, so that the horizontal deflection sensitivity can be improved.

If the starting point of the windings of the vertical deflecting coils 32*a* and 32*b* is adjusted to 20°, in the deflection yoke that is applied to the flat color cathode ray tube apparatus having a diagonal dimension of 66 cm, for example, the length L1 of the horizontal deflecting coils 30*a* and 30*b* and the distance L3 from the small-diameter end of the core 34 to the center of the coma coil 40 can be set to 86 mm and 30 mm, respectively. Thus, the horizontal deflection sensitivity can be improved by about 25% when compared with the conventional case.

Since the vertical deflecting coils 32*a* and 32*b* are divided in a plurality of parts in which the winding distribution is close as they are wound, moreover, the convergence of the electron beams can be adjusted with ease. If the vertical deflecting coils are wound in a manner such that their close-distribution portions are divided in a plurality of parts, as shown in FIG. 12, therefore, the convergence can be improved, and the distortion can be lessened when compared with the case where no division is made.

Thus, there may be provided a color cathode ray tube apparatus of which the image characteristic of the entire image screen is improved and which comprises a deflection yoke having outstanding deflection sensitivity.

This invention is not limited to the embodiment described above, and various modifications may be effected therein without departing from the scope of the invention. For example, the same functions and effects may be obtained if the windings of the vertical coils are distributed or wound so that they are divided by means of slots in the core or comb-shaped projections that are attached to the core, thereby forming a group of windings. Further, this invention is not limited to a color cathode ray tube apparatus and is also applicable to a monochromatic cathode ray tube apparatus.

What is claimed is:

1. A deflection yoke comprising:

a pair of saddle-type horizontal deflecting coils located substantially symmetrically with respect to a central axis and having a substantially truncated pyramid shape;

a magnetic core coaxial with the central axis, located on an outer peripheral side of the horizontal deflecting coils, and having a substantially truncated cone shape; and a pair of vertical deflecting coils, each having windings that are toroidally wound around the magnetic core, wherein for a position of a horizontal axis perpendicular to the central axis and a position of a vertical axis perpendicular to the central axis and the horizontal axis are given by 0°and 90°, respectively, along a circumferential direction around the central axis, the winding of one of the vertical deflecting coils has a starting point on the horizontal-axis side within a range of about 5°–30° and is distributed continuously or intermittently from the starting point to 90° so as to have a plurality of peak parts of a winding ratio in a winding distribution and is wound substantially symmetrically with respect to the vertical axis, and wherein the respective windings of the one vertical deflecting coil and the other vertical deflecting coil are wound substantially symmetrically with respect to the horizontal axis.

2. A deflection yoke according to claim 1, wherein said plurality of peak parts are located near ranges of about 20°–40° and about 60°–80° at the least.

3. A deflection yoke according to claim 1, wherein each of the horizontal deflecting coils has a large-diameter end and a small-diameter end, the small-diameter end having a bendless shape without any bends in a direction perpendicular to the central axis.

4. A deflection yoke according to claim 3, which further comprises a coma coil located coaxially with the central axis of the horizontal deflecting coils and at a distance from the small-diameter end of the horizontal deflecting coil in the direction of the central axis, and wherein L1, L2 and L3 are set to have relations:

$$L1>L2>L3,$$

$$L3=0.6\times L2-0.8\times L2,$$

where L1 is an effective length of the horizontal deflecting coil in the direction of the central axis, L2 is the length of the core in the direction of the central axis, and L3 is the distance between a small-diameter end of the core and the coma coil in the direction of the central axis.

5. A cathode ray tube apparatus comprising:

a vacuum envelope including a panel having a phosphor screen formed on an inner surface thereof, a funnel fixed to the panel, a cylindrical neck fixed to a small-diameter end of the funnel, and a yoke mounting portion having a substantially truncated pyramid shape ranging from the neck to an outer periphery of the funnel;

an electron gun which is located in the neck of the vacuum envelope and emits electron beams toward the phosphor screen; and a deflection yoke which is mounted outside of the yoke mounting portion and deflects the electron beams in horizontal and vertical directions, wherein the deflection yoke includes a pair of saddle-type horizontal deflecting coils located substantially symmetrically with respect to a central axis and having a substantially truncated pyramid shave, wherein the deflection yoke includes a magnetic core coaxial with the central axis, located on an outer peripheral side of the horizontal deflecting coils, and has a substantially truncated cone shape, wherein the deflection yoke includes a pair of vertical deflecting coils each having windings that are toroidally wound around the magnetic core, wherein for a position of a horizontal axis perpendicular to the central axis and a position of a vertical axis perpendicular to the central axis and the horizontal axis are given by 0° and 90°, respectively, along a circumferential direction around the central axis, the winding of one of the vertical deflecting coils has a starting point on the horizontal-axis side within a range of about 5°–30° and is distributed continuously or intermittently from the starting point to 90° so as to have a plurality of peak parts of a winding ratio in a winding distribution and is wound substantially symmetrically with respect to the vertical axis, and wherein the respective windings of the one vertical deflecting coil and the other vertical deflecting coil are wound substantially symmetrically with respect to the horizontal axis.

6. A cathode ray tube apparatus according to claim 5, wherein said plurality of peak parts are located near ranges of about 20°–40° and about 60°–80° at the least.

7. A cathode ray tube apparatus according to claim 5, wherein each of the horizontal deflecting coils has a large-diameter end and a small-diameter end, the small-diameter end having a bendless shape without any bends in a direction perpendicular to the central axis.

8. A cathode ray tube apparatus according to claim 7, which further comprises a coma coil located coaxially with the central axis of the horizontal deflecting coils and at a distance from the small-diameter end of the horizontal deflecting coil in the direction of the central axis, and wherein L1, L2 and L3 are set to have relations:

$$L1>L2>L3,$$

$$L3=0.6\times L2-0.8\times L2,$$

where L1 is the effective length of the horizontal deflecting coil in the direction of the central axis, L2 is the length of the core in the direction of the central axis, and L3 is the distance between a small-diameter end of the core and the coma coil in the direction of the central axis.

* * * * *